US005713470A

United States Patent [19]

Presta

[11] Patent Number: 5,713,470

[45] Date of Patent: Feb. 3, 1998

[54] STORAGE AND DISPLAY APPARATUS FOR TOYS

[76] Inventor: Donald J. Presta, 1773 Canterbury Cir., Anaheim, Calif. 92802

[21] Appl. No.: 511,455

[22] Filed: Aug. 4, 1995

[51] Int. Cl.[6] ..... B65D 25/00; B65D 85/00

[52] U.S. Cl. ..... 206/526; 206/806; 211/181; 220/668; 446/491

[58] Field of Search ..... 206/526, 730, 206/732, 733, 806, 459.1, 459.5, 486; 211/96, 116, 119, 180, 181; 217/42, 49; 220/9.1–9.3, 607, 668; 446/491; 43/100

[56] References Cited

U.S. PATENT DOCUMENTS

| | | | |
|---|---|---|---|
| 1,619,366 | 3/1927 | Peterson | 43/100 |
| 1,885,104 | 11/1932 | Bates | 211/181 |
| 2,043,032 | 6/1936 | Brasfield | 211/181 |
| 2,731,761 | 1/1956 | Marshall | 220/668 |
| 3,176,427 | 4/1965 | Hershey | 43/100 |
| 3,906,655 | 9/1975 | Lowenthal, Jr. | 43/100 |
| 4,682,692 | 7/1987 | Kessler | 206/459.5 |
| 5,027,948 | 7/1991 | Forbes et al. | 206/806 |
| 5,505,651 | 4/1996 | Coughlin | 446/73 |

*Primary Examiner*—Jimmy G. Foster
*Attorney, Agent, or Firm*—Roy A. Ekstrand

[57] ABSTRACT

A mesh housing defining an interior cavity and enclosing side walls and top walls is fabricated of a coarse open mesh material. The housing includes access door apertures which facilitate the storage of toy articles within the mesh housing interior cavity. A plurality of toy articles such as toy action figures or the like are readily stored and displayed upon the outer surfaces of the mesh housing by engaging the coarse mesh housing and hanging the articles thereon. A variety of mesh materials and mesh styles are utilized. Alternate embodiments are shown setting forth cylindrical and triangular mesh housing shapes as well as free standing or wall and door attachment embodiments.

11 Claims, 2 Drawing Sheets

STORAGE AND DISPLAY APPARATUS FOR TOYS

FIELD OF THE INVENTION

This invention relates generally to toy storage apparatus and particularly to storage apparatus which provides a display of stored toys.

BACKGROUND OF THE INVENTION

In many households throughout the world in which young children reside, the situation arises in which the children accumulate a substantial number of toys and toy products. The variety and configuration of such toys and toy products in virtually endless and depends to a large extent upon the gender and age of the child or children within the household. Notwithstanding these variations, however, a common problem experienced by virtually all members of such households is found in dealing with the storage of such numerous toy articles. Historically, parents have attempted to provide storage facilities within the household such as conventional toy boxes or chests as well as multiple drawer cabinets, closet areas, or the like. While some benefit is realized by such conventional toy storage apparatus, they have been found to be particularly suited to the storage of larger toys. Generally speaking, larger toys are found to be more easily storable and may be readily placed within and removed from a conventional storage apparatus. However, the problem encountered in connection with small toys is more difficult to resolve. While young children may be easily persuaded to put away or store several larger toys within conventional toy storage apparatus, greater persuasion and perhaps discipline is required to convince young children to return several hundred small toys to a toy storage apparatus at the completion of the play period.

Recent trends in toy manufacture has provided a great variety of small dolls or toy figures for use by younger children. Young girls, for example, frequently are targeted by toy manufacturers selling attractive miniature dolls and fashion dolls together with a number of accessories used in connection with such dolls. Similarly, a toy category known generally as action figures or as male action figures has grown dramatically in recent years. Generally speaking, action figures are doll-like figures having various human and human-like appearances and shapes. The variety of such male action figures is virtually endless and ranges from human-like figures to mechanical robot creations, monsters, fanciful animals or animal-like humanoid figures or creatures best described as purely fanciful.

One result of the great increase in miniature or small dolls and male action figures has been the tendency of child consumers to collect great numbers of such dolls or toy figures often accumulating a hundred or more of such toys. It has been found that children are reluctant to return such large collections of dolls or toy figures to a conventional toy storage apparatus such as a toy chest or toy box between play sessions. Many children prefer to display their toy figure or doll collection upon a convenient surface as an alternative to conventional storage. However, such display often clutters furniture surfaces within the child's room which the parents would prefer be used for other purposes.

In the face of the reluctance of children to store or put away such large numbers of toy figures or dolls, a need arises in the art for a convenient storage and display apparatus for such toys.

SUMMARY OF THE INVENTION

Accordingly, it is a general object of the present invention to provide an improved storage and display apparatus for toys. It is a more particular object of the present invention to provide a storage and display apparatus for toys which is particularly well suited to convenient use in connection with large numbers or dolls or action toy figures. It is a further object of the present invention to provide an improved storage and display apparatus for toys which is amusing and interesting to use and encourages the child user to store or display dolls or toy figures thereon.

In accordance with the present invention, there is provided for use in storing and displaying a plurality of toy articles, a toy storage and display apparatus comprising: a mesh housing formed of coarse open mesh material and defining an interior cavity for storing a plurality of toy articles and an outer wall; and a door opening formed in the outer wall and providing access to the interior cavity, the mesh material defining a plurality of apertures for receiving portions of a plurality of toy articles in an engaging support whereby the plurality of toy articles are hung upon the mesh housing for display.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
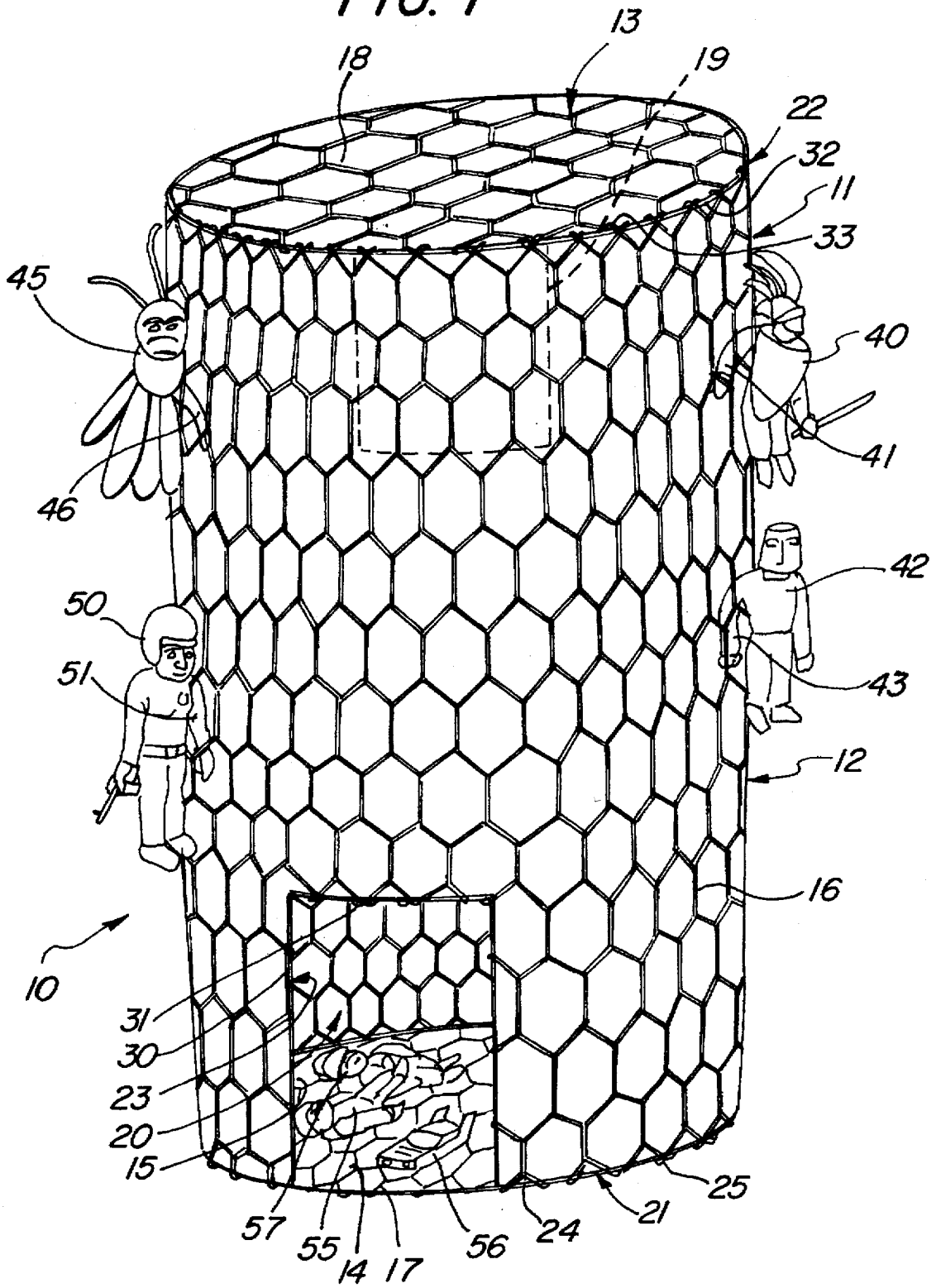
FIG. 1 sets forth a perspective view of a storage and display apparatus for toys constructed in accordance with the present invention and having several action figures stored therewith.
Figure 2:
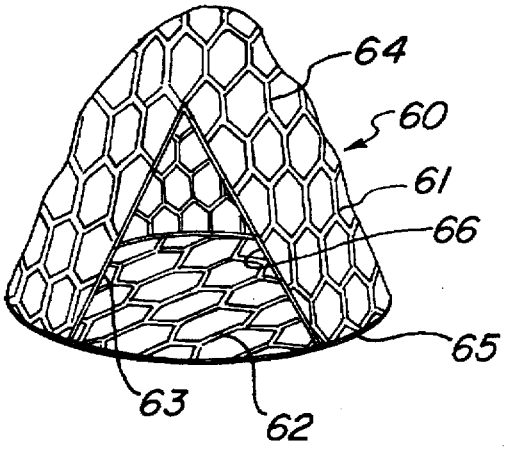
FIG. 2 sets forth a partial view of an alternate embodiment of the present invention storage and display apparatus for toys.

FIG. 1 sets forth a perspective view of a storage and display apparatus for toys constructed in accordance with the present invention and generally referenced by numeral 10. Storage and display apparatus 10 includes a generally cylindrical mesh housing 11 having a generally cylindrical side wall 12 formed of a coarse open mesh material 16. Mesh material 16 may be fabricated using virtually any conventional mesh construction such as a twisted wire mesh or molded plastic mesh such as shown in FIG. 2 or other conventional fabrication. The essential element of mesh material 16 and the remaining mesh material shown in FIGS. 1 through 4 is the provision of large open apertures which facilitate the free passage of air therethrough and which facilitate the easy engagement and attachment of toy articles in the manner shown in FIG. 1. Mesh housing 11 further includes a planar bottom wall 14 formed of an open mesh 17 and a top wall 13 formed of an open mesh 18. Cylindrical side wall 12 is joined to bottom wall 14 and top wall 13 at seams 21 and 22 respectively. In the example shown in FIG. 1 in which meshes 16, 17 and 18 comprise wire mesh material, seams 21 and 22 are preferably formed using a pair of seam wires 24 and 32 respectively. Seam wires 24 and 32 are engaged by a plurality of loops 25 and 33 extending from meshes 16, 17 and 18 to mutually wrap about the seam wires to provide strong attachment therebetween. It will be recognized, however, that other methods of attachment may be utilized which need not employ seam wires 24 and 32. Cylindrical side wall 12 further defines an interior cavity 20 and a door aperture 15 providing access thereto. In its preferred form, door aperture 15 is surrounded by a seam 23 preferably formed of a seam wire 30 having a plurality of loops 31 extending from mesh 16 thereabout. Once again, it will be recognized by those skilled in the art that door aperture 15 may be formed in other conventional fabrication manners without departing from the spirit and scope of the present invention.

In operation, mesh housing 11 is preferably fabricated of mesh material having sufficient strength to provide a free-standing, somewhat rigid housing easily self supporting upon a convenient floor or furniture surface. Thus with toy storage and display apparatus 10 resting upon bottom wall 14 and supporting its own weight, a plurality of toy articles such as toy FIGS. 55 through 58 may be conveniently stored within interior cavity 20. It will be recognized that while a small number of toy articles 55 through 58 are shown stored within interior cavity 20, the storage of articles within display and storage apparatus 10 is not limited short of the volume of interior cavity 20. Thus, mesh housing 11 may be virtually filled with toy articles to provide maximum storage of toy articles. In accordance with an important aspect of the present invention, a plurality of toy articles such as male action figures or other toy articles may be loosely secured to and supported by cylindrical side wall 12 as well as top wall 13 due to the open construction of mesh materials 16 and 18. For purposes of illustration, a toy FIG. 40 replicating a warrior and having an extending arm 41 is shown secured to side wall 12 as arm 41 is simply inserted through an opening in mesh 16. Thereafter, release of toy FIG. 40 allows it simply hung by arm 41 within mesh 16 of side wall 12. Similarly, a toy FIG. 42 having an arm 43 is secured within mesh 16. By way of further illustration, a toy robot 50 having an arm 51 is supported upon mesh side wall 12 while a toy FIG. 45 generally replicating a fanciful octopus is loosely supported by side wall 12 as a tentacle 46 is inserted through an open portion of mesh 16. It will be recognized by those skilled in the art that virtually any toy article may be loosely and conveniently stored upon the outer surface of cylindrical side wall 12 by simply engaging the open portions of mesh material 16. While virtually any toy article may be secured to side wall 12, it is believed the present invention toy storage and display apparatus provides particular attractiveness and advantage in connection with dolls and toy figures which are readily attached to the side wall surface. However, the present invention is by no means limited to any particular toy provided such toy has a convenient extending portion or appendage or the like which may freely engage mesh material 16 of side wall 12. It should be noted that while four toy articles 40, 42, 45 and 50 are shown supported upon cylindrical side wall 12 for convenient illustration, the practical use of the present invention toy storage and display apparatus anticipates the attachment of a very large number of toy figures and toy articles. For example, it may be highly appealing to young children to place their entire collection of toy figures and similar toy articles upon cylindrical wall 12 to attempt to virtually cover the cylindrical wall.

In addition to providing a convenient storage apparatus and display apparatus, the present invention toy storage and display apparatus may be utilized in any number of game play patterns without departing from the spirit and scope of the present invention. In such case, the open mesh construction of cylindrical side wall 12 as well as top wall 13 may facilitate other play patterns such as simulated climbing of toy figures or the like. As a result, the present invention apparatus provides the additional play value of a play apparatus without increasing the cost or complexity of the structure. It will be further recognized by those skilled in the art that it may be desirable to provide an additional aperture higher up upon cylindrical wall 12 or provide hinged construction of top wall 13 to facilitate the easy deposit of stored toy articles within cylindrical wall 12. For purposes of illustration, an additional door aperture 19 is shown in dashed-line representation in FIG. 1 to illustrate this capability.

FIG. 2 sets forth a partial view of an alternate embodiment of the present invention toy storage and display apparatus generally referenced by numeral 60. In its preferred from, apparatus 60 defines a substantially cylindrical shape as shown in FIG. 1 having a cylindrical side wall 61, a bottom wall 62 and a door opening 63. Thus, apparatus 60 conforms generally to the structure shown in FIG. 1 with the primary difference being the shape of door opening 63 and the fabrication of side wall 61 and bottom wall 62. In the embodiment of FIG. 2, side wall 61 and bottom wall 62 are fabricated of a molded plastic mesh material 64. Molded mesh material 64 is generally similar to mesh 16 used in apparatus 10 in FIG. 1. Thus, molded mesh 64 is a substantially coarse mesh material defining large openings and having molded plastic webbing or mesh support. Mesh 64 of side wall 61 is joined to bottom wall 62 at a seam 65. Door opening 63 is shown having a generally triangular shape and is bordered by a door seam 66. It will be apparent to those skilled in the art from examination of FIGS. 1, 2 and 3 that a variety of door opening shapes may be utilized in the present invention apparatus without departing from the spirit and scope thereof. Thus, it should be understood that while rectangular, triangular, and circular door openings are shown for purposes of illustration, virtually any doorway shape may be utilized while practicing the present invention. The important aspect of the door opening is to provide access to the interior of the open mesh housing for toy storage and retrieval.

Figure 3:
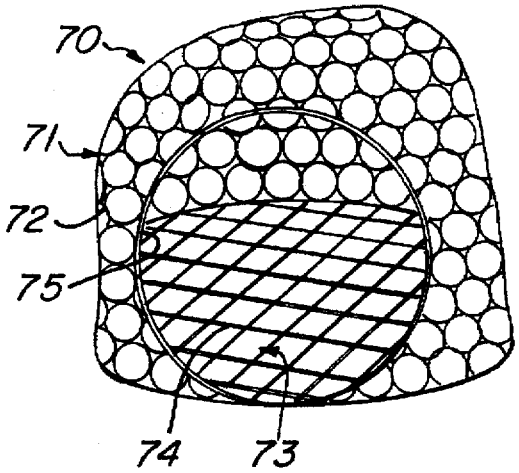
FIG. 3 sets forth a partial view of a still further alternate embodiment of the present invention storage and display apparatus for toys.

FIG. 3 sets forth a still further alternate embodiment of the present invention toy storage and display apparatus generally referenced by numeral 70. Storage apparatus 70 is fabricated of a side wall 71 formed of a mesh material 72. A bottom wall 73 formed of a mesh material 74 is joined to side wall 71. Side wall 71 defines a circular door opening 75. Mesh 72 is fabricated to provide a plurality of circular openings to illustrate further variation of the present invention and may, for example, be formed of a molded plastic mesh or, alternatively, fabricated in another manner such as a thin material sheet having a plurality of holes punched therethrough in close spacing. The essential feature of mesh material 72 is to provide the coarse mesh large opening quality which facilitates the attachment of toy figures and toy articles to side wall 71 in the manner set forth above in FIG. 1. Mesh 74 of bottom wall 73 utilizes a rectangular mesh to provide further illustration of alternative mesh configurations. Thus, it will be apparent to those skilled in the art that a variety of coarse open mesh materials may be utilized in practicing the present invention without departing from the spirit and scope thereof. It should be further apparent to those skilled in the art that the shape of the mesh material housing used in the present invention is not limited to the generally cylindrical shape shown in FIG. 1 and referred to in FIGS. 2 and 3. On the contrary, a variety of shapes such as rectangular, prismatic or triangularly prismatic may be utilized without departing from the spirit and scope of the present invention.

Figure 4:
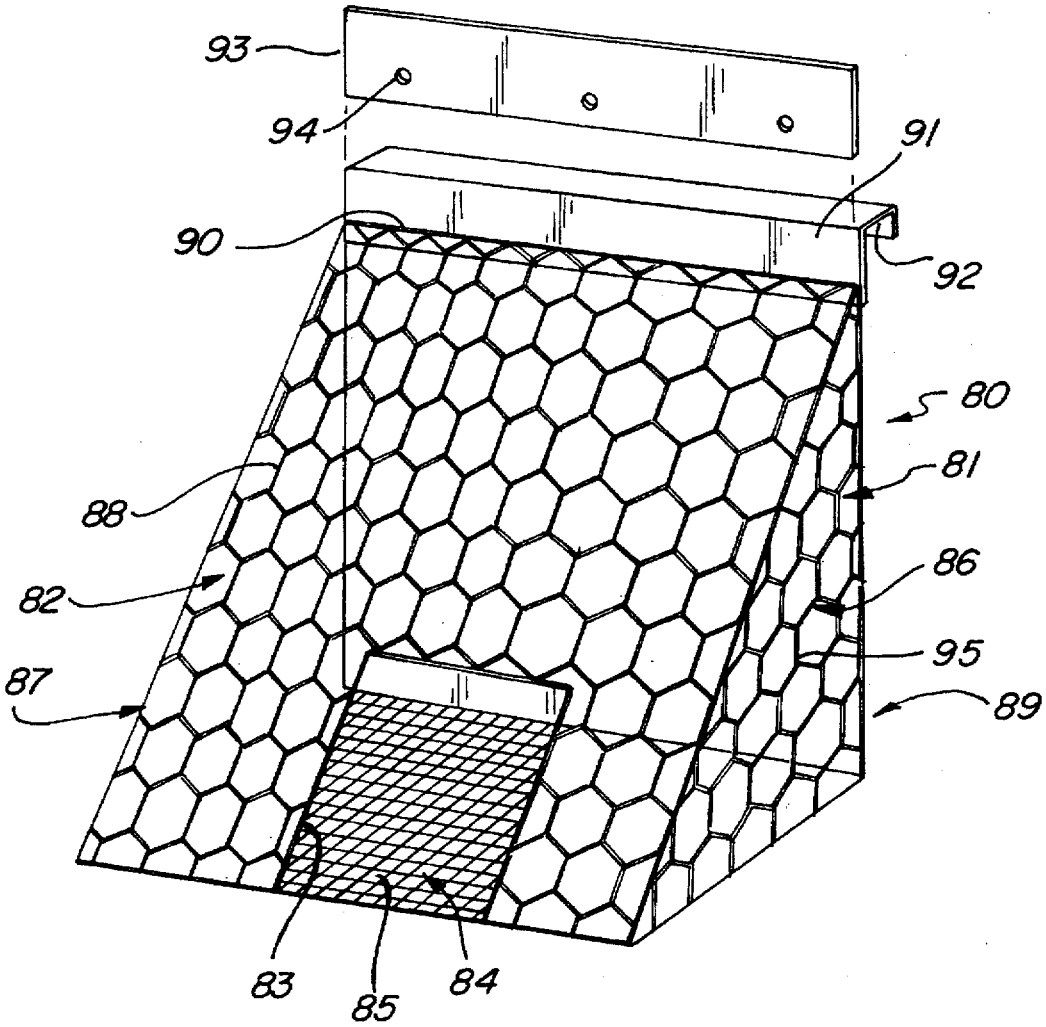
FIG. 4 sets forth a perspective view of a still further alternate embodiment of the present invention storage and display apparatus for toys.

FIG. 4 sets forth a perspective view of a still further alternate embodiment of the present invention toy storage and display apparatus generally referenced by numeral 80. Apparatus 80 includes a triangular prism housing 81 having an angled front wall 82 secured to a pair of triangular side walls 86 and 87. Mesh housing 81 further includes a planar back wall 89 and a planar bottom surface 84. Angled front wall 82 is formed of a mesh material 88 and further defines a door opening 83. Side walls 86 and 87 are formed of a mesh material 95 while bottom surface 84 is formed of a straight mesh material 85. Back wall 89 may be formed of similar mesh material or, alternatively, may be solid non-mesh material as shown in FIG. 4. Angled front wall 82 and back wall 89 are commonly joined to an elongated top plate 91 along a top seam 90 using conventional fabrication techniques. Top plate 91 is configured to be received upon the upper edge of a door or similar structural element. Accordingly, top plate 91 defines a door channel 92 by which top plate 91 may be fitted upon the upper edge of a door or other convenient structural element and thereby support apparatus 80 upon the door surface. Alternatively, it may be desirable to secure apparatus 80 to a convenient flat wall surface such as a dwelling wall or the like. In such case, a generally planar wall plate 93 having a plurality of attachment apertures 94 defined therein is secured to top seam 90 in place of top plate 91 to adapt apparatus 80 for flat wall attachment. In either case, the attachment of top seam 90 to either top plate 91 or wall plate 93 is carried forward in accordance with conventional fabrication techniques suitable for the material from which mesh housing 81 is formed.

Thus, with apparatus 80 secured to a door or wall surface, a plurality of toy articles may be conveniently stored within the interior of mesh housing 81. Similarly, a plurality of toy articles may be readily secured to and displayed upon the exterior surfaces of mesh housing 81 in the same manner set forth above in FIG. 1 for apparatus 10. By way of further similarity, the open mesh construction of mesh housing 81 may further facilitate the use of various toy article play patterns such as simulated climbing of toy figures or the like.

What has been shown is a toy storage and display apparatus which utilizes a mesh housing fabricated of a coarse open mesh material to form both an interior storage cavity and to provide an outer surface upon which a large number of toy articles may be displayed and stored by simple engagement of the open mesh. The apparatus may be fabricated using virtually any material capable of forming a coarse open mesh such as woven wire, molded plastic, or thin sheet material having a plurality of apertures punched therein. The entire structure is extremely lightweight and low in cost and may be provided in various housing shapes to suit the consumer's preferences. Because the apparatus is enjoyable to use, it is anticipated that child users who might otherwise resist parental guidance toward cleaning up and storing toy articles may find the exercise of placing the toy articles such as toy figures upon the outer surface of the toy storage and display apparatus of sufficient amusement and enjoyment value that little or no encouragement will be required.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in storing and displaying a plurality of toy articles, a combination of toy articles and a toy storage and display apparatus comprising:

a free-standing mesh housing formed of coarse open mesh material and defining an interior cavity for storing a plurality of said toy articles, a bottom support surface and an outer wall; and a door opening formed in said outer wall and providing access to said interior cavity, said mesh material defining a plurality of apertures each having downwardly converging bottom portions receiving portions of said plurality of toy articles in an engaging support whereby said plurality of toy articles are hung upon said mesh housing and engage said converging bottom portions of said apertures for display upon the exterior of said mesh housing.

2. A toy storage and display apparatus as set forth in claim 1 wherein said mesh material is formed of metal wire mesh.

3. A toy storage and display apparatus as set forth in claim 2 wherein said mesh housing is generally cylindrical.

4. A toy storage and display apparatus as set forth in claim 3 wherein said door opening is generally rectangular.

5. A toy storage and display apparatus as set forth in claim 1 wherein said door opening is generally triangular.

6. A toy storage and display apparatus as set forth in claim 5 wherein said mesh material is formed of molded plastic.

7. A toy storage display apparatus as set forth in claim 1 wherein said mesh material defines a plurality of generally circular apertures.

8. A toy storage and display apparatus as set forth in claim 1 wherein said door opening is generally circular.

9. A toy storage and display apparatus as set forth in claim 1 wherein said mesh housing includes means for attaching said apparatus to a door top edge.

10. A toy storage and display apparatus as set forth in claim 1 wherein said mesh housing includes means for attaching said apparatus to a wall surface.

11. A toy storage and display apparatus as set forth in claim 1 wherein said mesh housing defines a generally triangular prismatic shape.

* * * * *